United States Patent [19]

Kaim

[11] Patent Number: 4,674,639

[45] Date of Patent: Jun. 23, 1987

[54] RAILWAY COUPLER CARRIER RETENTION SYSTEM

[75] Inventor: John W. Kaim, Chicago, Ill.

[73] Assignee: AMSTED Industries Incorporated, Chicago, Ill.

[21] Appl. No.: 659,184

[22] Filed: Oct. 9, 1984

[51] Int. Cl.[4] ..... B61G 7/10

[52] U.S. Cl. ..... 213/61; 213/62 R

[58] Field of Search ..... 213/61, 62 A, 58, 59, 213/60

[56] References Cited

U.S. PATENT DOCUMENTS

| | | | |
|---|---|---|---|
| 2,894,646 | 7/1959 | Hicks | 213/61 X |
| 2,899,083 | 8/1959 | Furniss | 213/61 |
| 3,394,821 | 7/1968 | Cordani | 213/61 |
| 4,445,618 | 5/1984 | Kulieke, Jr. | 213/61 |

*Primary Examiner*—Randolph A. Reese
*Assistant Examiner*—Glenn B. Foster
*Attorney, Agent, or Firm*—Charles E. Bouton; Edward J. Brosius

[57] ABSTRACT

An improved railway car striker assembly including a spring supported coupler carrier wherein the carrier has laterally extending lugs with chevron shaped bearing surfaces engageable with congruent surfaces on retainer plates to restrain longitudinal and lateral movement of the carrier.

7 Claims, 6 Drawing Figures

RAILWAY COUPLER CARRIER RETENTION SYSTEM

The present invention relates to an improved coupler carrier retention system for resiliently supporting couplers on railway cars; and more particularly pertains to improved coupler carrier and retainer plates within a striker for reducing wear.

PRIOR ART

Railway cars are supported on the bolsters (or transverse crosspieces) of trucks which include wheels mounted on sideframes. Successive cars in a train are connected by couplers which are connected to car body bolsters above the truck bolsters and extend beyond each end of the car body from beneath a longitudinal center sill. The couplers are of heavy construction to withstand and transmit the largely longitudinal pulling and braking forces between cars. However, because trains must negotiate turns and grades, and because the vertical level of couplers may not be uniform between all cars, the couplers must also accommodate vertical and horizontal displacements between successive cars and couplers.

To some extent, such displacements may be partly compensated at the mating faces and surfaces of two interconnected couplers; and each coupler is mounted for limited vertical and horizontal angling. However, the American Association of Railroads standard "F" Interlocking Coupler has relatively close fitting surfaces which provide for a minimum of free slack as compared to other coupler designs. Thus, especially in the "F" type couplers, the angling movements of the coupler body must accommodate the aforementioned displacements.

Vertical and horizontal (lateral) angling of the coupler is permitted by a pivotal connection between coupler and yoke. However, it is necessary to support the weight of the coupler beneath the railway car. This is accomplished by a carrier that is spring mounted for limited vertical movement within a striker secured to the car underside at the end of the center sill. The coupler body extends through the striker resting on the carrier and may angle by moving vertically and horizontally (laterally) within the confines of the carrier and the striker top and side walls. Such striker and carrier parts are normally steel castings.

Certain parts of the striker and carrier are subject to wear. Provisions have been made to protect some vertical parts against excessive wear as shown in U.S. Pat. No. 4,376,488 to Russell G. Altherr and in pending U.S. application Ser. No. 542,271 filed Oct. 17, 1983 by Russell G. Altherr.

The coupler, being subjected to tremendous longitudinal forces, will also move, to a limited extent, in fore and aft directions through the striker and across the carrier. All of the coupler movements tend to wear the striker spring basket and coupler carrier, but it is particularly the longitudinal movements that have been found to cause excessive wear of not only the upper surface of the carrier but also of the carrier body and parts adjacent thereto, particularly the lugs and the retainer plates limiting upward movement of the carrier. Such wear results in improper vertical orientation of the coupler and in excessive repair and replacement costs.

BRIEF SUMMARY OF THE INVENTION

It is accordingly an object of the present invention to provide an improved carrier and retainer plates to reduce wear thereon and on the surfaces of a striker basket.

It is another object of the present invention to provide an improved carrier and retainer plates so as to reduce the wear of those parts and facilitate proper vertical, longitudinal and lateral positioning of the carrier in a striker assembly.

The present invention basically involves the forming of cooperatively engaging angled bearing surfaces on each of the carrier lugs and retainer plate whereby to resist longitudinal and lateral movement of said carrier. The upper surface of the carrier is also preferably recessed to receive a replaceable reduced friction wear plate.

BRIEF DESCRIPTION OF THE DRAWINGS

Further objects and advantages may be understood from a reading of the detailed description of the invention in conjunction with the drawings wherein.

DETAILED DESCRIPTION OF THE INVENTION

Figure 1:
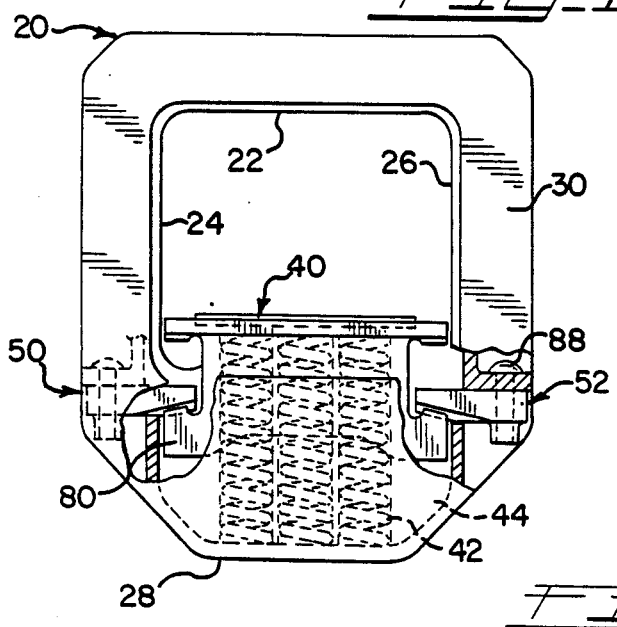
FIG. 1 is an end elevation view of a striker with parts broken away to show the carrier and retainer plates of the present invention.
Figure 5:
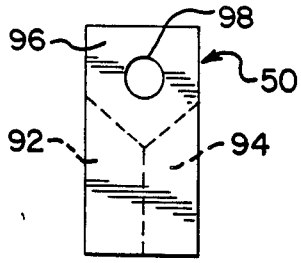
FIG. 5 is a detail plan view of a retainer plate removed from the apparatus of FIG. 1.
Figure 6:
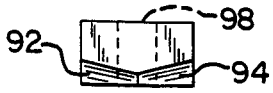
FIG. 6 is a detail end view of the retainer plate of FIG. 5.
Figure 4:
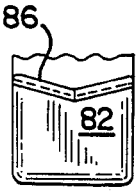
FIG. 4 is a partial end elevation view of the carrier of FIG. 3.

In FIG. 1, a striker assembly, generally 20, is shown. It will be understood that the upper wall 22 of the striker comprising sidewalls 24, 26, bottom 28 and striker flange 30, is normally positioned beneath the end of a center sill (not shown) of a railway car, and that the body of a coupler (also not shown) normally extends toward the viewer through the opening defined by the flange 30 and a coupler carrier, generally 40.

The coupler carrier 40 is in the form of a substantially hollow cap which is open at the bottom and receives therein the upper portions of a plurality of vertical coil springs 42 which are supported in a striker spring basket 44 formed within the bottom 28 of the striker assembly, generally 20. Thus, the carrier 40 may move vertically on the springs 42 between the striker side walls 24 and 26. When properly assembled, the springs 42 are partially compressed and the upper limit of travel of the carrier, generally 40, is confined by retainer plates, generally 50, 52, secured at either side wall 24 and 26. Thus, the weight of the coupler is normally supported by the carrier 40 and springs 42 at the uppermost carrier position.

Figure 2:
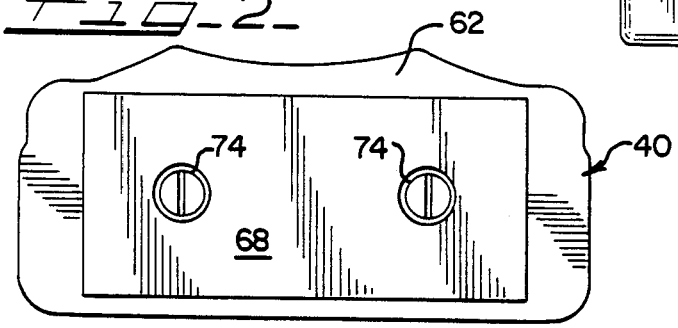
FIG. 2 is a detail plan view of the carrier removed from the apparatus shown in FIG. 1.
Figure 3:
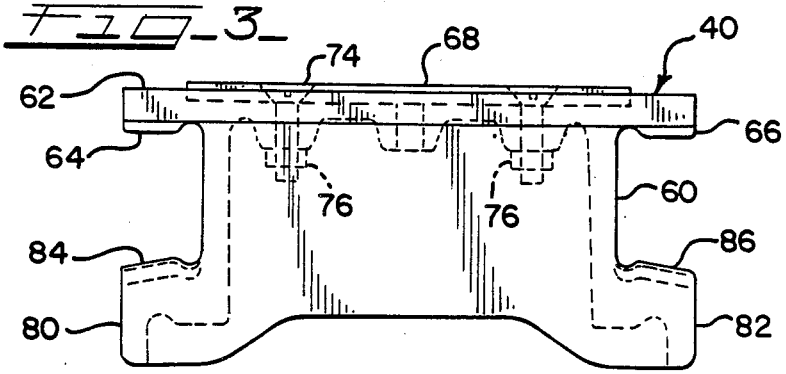
FIG. 3 is a detail elevation view of the carrier of FIG. 2.

As may be best seen in FIGS. 2 and 3, the coupler carrier, generally 40, comprises a substantially rectangular hollow body 60 enclosed at the upper portion by a top wall 62 which extends outwardly (in a lateral direction) of the body at each end to form detents 64, 66. The upper surface of top wall 62 contains a rectangular recess to receive a replacable wear plate 68.

Where a wear plate 68 is utilized it may be of steel, although preferably such wear plate is of a relatively lower coefficient of friction to enable the coupler to slide easily across the top wall 62. The wear plate 68 may be comprised of a low friction plastic material such as that produced and marketed by the Holland Company under the trademark "HOLLUBE". The wear plate 68 may be fastened in place by any suitable means as by welding brazing cementing or the like. Countersunk fasteners are preferred such as the illustrated flat head counter sunk bolts 74 which thread into captive nuts 76 secured to nipples on the underside of the top wall 62. The mountings for such nuts 76 may also serve to position the tops of the springs 72.

The hollow body 60 of carrier 40 terminates at the lower portion in the form of end lugs 80, 82 which extend outwardly (laterally) beneath the detents 64, 66 respectively. The upper surfaces of each lug 80, 82 slopes downwardly (in the lateral direction) from the body 60 at about 10° to the horizontal; and also slopes downwardly from the front and back sides toward the center thereof (in a longitudinal direction respecting the assembled parts) at about 15° to the horizontal, thereby forming non-planar angled bearing means 84, 86, preferably chevron shaped as illustrated, at each end of the carrier 40.

As previously mentioned the carrier body 60 is vertically reciprocable within a basket 44 which holds springs 42 at the bottom 28 of the striker assembly, generally 20. Lugs 80, 82 and detents 64, 66 of the carrier, generally 40, extend laterally toward the striker side walls 24, 26 respectively where retainer plates 50, 52 are located. The latter are contacted by the lugs 80, 82 and thereby serve to limit upward movement of the carrier 40 by reason of the retainer plates 50, 52 respectively, extending laterally into the space between detent 64 and lug 80 at the left side and between detent 66 and lug 82 at the right side (as viewed in FIGS. 1 and 3). Downward movement of the carrier body 60 is limited by contact of the top wall 62 with the upper edge of the spring basket 44.

The retainer plates 50, 52 are also replaceable and are preferably secured to flanges in holes cast in the striker side walls by two piece rivets 88 or the like. According to the present invention, the undersurfaces of the retainer plates also form angled bearing means congruent to the bearing means 84, 86 on the carrier lugs 80, 82. This is accomplished by forming the undersurface of each retainer plate to contain two adjacent faces 92, 94 each of which faces are sloped in two directions at approximately 10° downward from an end and at about 15° upward from the center toward the outer edges. It will be seen that the two retainer plates 50, 52 are identical (being merely mounted to face in opposite directions) with flat upper surfaces 96 and holes 98 for the rivets 88.

Each retainer plate is also preferably of rectangular plan formed from steel with the faces 92, 94 advantageously flame hardened or quenched and tempered to about 400 BHN (Brinell Hardness Number).

When the aforedescribed parts are assembled, the retainer plates 50, 52 project inwardly from sides 24, 26 with their flat upper surfaces 96 disposed upwardly toward upper wall 22 of the striker assembly; and the coupler carrier generally 40 is compressed downwardly on the springs 42 and held against upward movement by the undersurfaces of the retainer plates bearing against the shaped upper surfaces of lugs 80, 82 of the carrier. The coupler body (not shown) rests upon the wear plate 68 and may move laterally from sidewall 24 to sidewall 26. Such movement tends to move the carrier 40 laterally against the retainer plates. The coupler may also be moved downward and upward and the carrier 40 will tend to remain in supporting contact by reason of springs 42. To some extent the coupler will also move fore and aft longitudinally across the wearplate 68 and tending to move the carrier 40 within basket 44 and against the retainer plates 50, 52. These movements are believed to have caused the greatest wear and damage to prior striker assemblies.

However, with the present invention, the angled bearing means on both the carrier lugs and retainer plates resists and retards such longitudinal movement of the carrier 40 and also resists lateral movement of the carrier when the coupler is moved, thus greatly reducing wear and replacement of parts.

Modifications and variations may be made in the aforedescribed invention without departing from the scope thereof which is defined hereafter in the claims.

What is claimed is:

1. An improved striker assembly apparatus for railway cars wherein a moveable coupler is vertically supported upon a carrier moveable in a vertical direction, and supported upon springs, said improvement comprising: two indented chevron shaped bearing means each formed by two joined planar surfaces on opposite ends of the carrier to resist both longitudinal and lateral movement of said carrier in said striker and two retainer plates positioned in said striker opposed to said bearing means to limit vertical movement of said carrier therein and including extended chevron shaped bearing means formed by two joined planar surfaces on said retainer plate congruent with said shaped bearing means on said carrier so as to provide lateral and longitudinal stability for said carrier.

2. The apparatus of claim 1 wherein the shaped bearing means on said retaineer plates are hardened.

3. The apparatus of claim 2 wherein shaped bearing means are hardened to about 400 BHN.

4. The apparatus of claim 1 wherein the said chevron shaped bearing means comprise surfaces sloped in two directions from a horizontal plane.

5. The apparatus of claim 4 wherein the said surfaces are sloped at about 10° in the lateral assembled direction and at about 15° in the longitudinal assembled direction.

6. The apparatus of Claim 1 wherein the upper surface of the carrier contains a recess and a wear plate mounted therein for sliding contact with the coupler.

7. The apparatus of claim 6 wherein the said wear plate is non-metallic and has a coefficient of friction lower than that of said shaped bearing means whereby the coupler may readily slide across the said wearplate and said carrier and the said bearing means is relatively more resistant to movement of the said carrier in said striker.

* * * * *